US006198455B1

(12) United States Patent
Luh

(10) Patent No.: US 6,198,455 B1
(45) Date of Patent: Mar. 6, 2001

(54) VARIABLE BEAMWIDTH ANTENNA SYSTEMS

(75) Inventor: Howard Ho-Shou Luh, Sunnyvale, CA (US)

(73) Assignee: Space Systems/Loral, Inc., Palo Alto ( * ) Notice: Subject to any disclaimer, the term of this patent is extended or adjusted under 35 U.S.C. 154(b) by 0 days.

(21) Appl. No.: 09/531,613

(22) Filed: Mar. 21, 2000

(51) Int. Cl.[7] ..... H01Q 13/00

(52) U.S. Cl. ..... 343/781 CA; 343/757; 343/765

(58) Field of Search ..... 343/757, 765, 343/781 CA, 781 R, 781 P, 758, 836, 837, 83 G, 840; H01Q 1/42, 13/00

(56) References Cited

U.S. PATENT DOCUMENTS 4,355,314 * 10/1982 Ohm ..... 343/779
4,866,457 * 9/1989 Hogg ..... 343/781 CA
6,043,788 * 3/2000 Seavey ..... 343/781 CA

* cited by examiner

*Primary Examiner*—Don Wong
*Assistant Examiner*—Tho Phan
(74) *Attorney, Agent, or Firm*—Kenneth W. Float

(57) ABSTRACT

Variable beamwidth antenna systems for use on spacecraft that is capable of changing their beamwidths while the spacecraft in on orbit. The variable beamwidth antenna systems include a main reflector, a subreflector, a feed horn, a main reflector displacement mechanism and a feed horn (or subreflector) displacement mechanism. For broaden the beamwidth, the RF feed horn and the subreflector are moved close together by proper distance. The main reflector is moved away from the subreflector along a line through centers of their respective surface by a distance given by a predetermined equation.

7 Claims, 4 Drawing Sheets

VARIABLE BEAMWIDTH ANTENNA SYSTEMS

BACKGROUND

The present invention relates generally to antennas for use on spacecraft, and more particularly, to variable beamwidth antenna systems designed for use on spacecraft.

The present invention relates to improvements in offset Gregorian reflector antenna systems for use on communication satellites. Due to unpredictability of communication traffic, it is desirable that the beamwidth of the antenna radiation pattern be changeable when the spacecraft is on orbit.

Accordingly, it would be advantageous to have improved variable beamwidth antenna systems that may be used on a spacecraft that has a changeable beamwidth.

SUMMARY OF THE INVENTION

The variable beamwidth antenna system comprises a main reflector, a reflector displacement mechanism, a subreflector, a feed horn, and a feed horn displacement mechanism. The reflector displacement mechanism can place the main reflector at any desired location, while the feed displacement mechanism can place the feed horn at any desired location. More specifically, the main reflector displacement mechanism controls the spacing between the main reflector and the subreflector; while the feed displacement mechanism controls the spacing between the feed and the subreflector.

To implement the present invention, two mechanical movements are required. First, the RF feed horn and the subreflector are moved closer together. Second, the main reflector is moved away from the subreflector. Alternatively, the subreflector is moved closer to the RF feed horn, and the main reflector is moved away from the subreflector.

Two mechanical movements are not independent. They are related by $$y = \frac{d^2x}{c^2 - x(c+d)}$$

where "x" is the distance of RF feed horn displacement, and "y" is the distance of the main reflector displacement.

When x=y=0, the antenna arrangement is in the focused condition. Under the focused condition, the focal point of the paraboloidal main reflector is coincident with one of the foci of the elliptical subreflector, and the feed horn is located at the other focus of the subreflector. The terms "c" and "d" in the above equation are the distance between the RF feed horn and the subreflector, and the distance between the focal point of the main reflector and subreflector, respectively, when the antenna is in focus.

A reduced-to-practice embodiment of the present variable beamwidth antenna has 3 dB beamwidth that can be changed while the spacecraft is on orbit by proper displacements of any two components among the main reflector, the subreflector and the feed.

BRIEF DESCRIPTION OF THE DRAWINGS

The various features and advantages of the present invention may be more readily understood with reference to the following detailed description taken in conjunction with the accompanying drawings wherein like reference numerals designate like structural elements, and in which.

DETAILED DESCRIPTION

Figure 1:
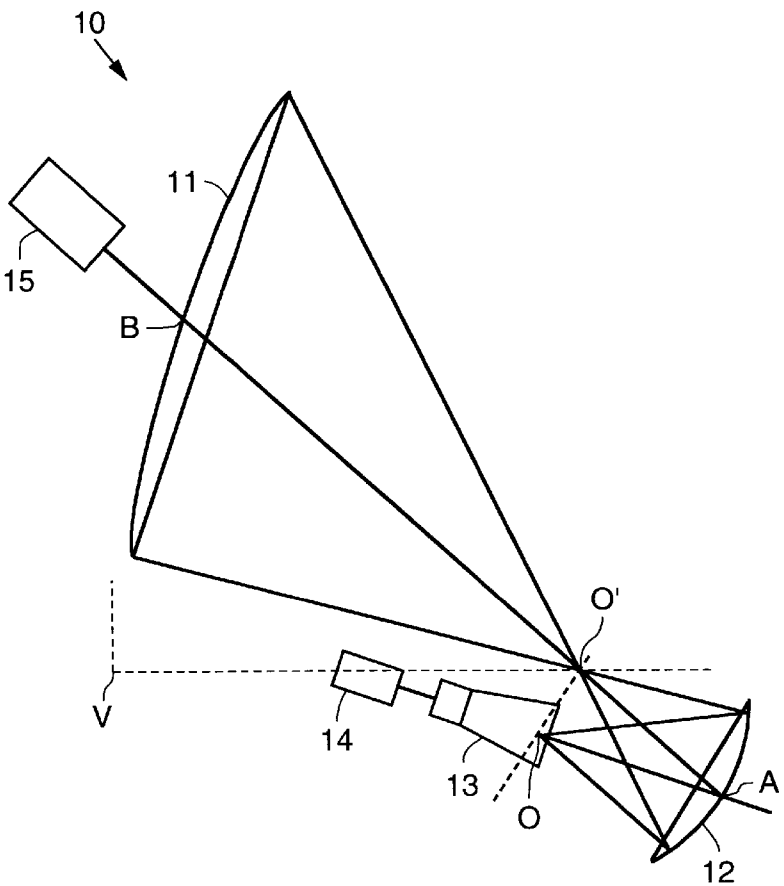
FIG. 1 illustrates a first embodiment of a variable beamwidth antenna system in accordance with the principles of the present invention.

Referring to the drawing figures, FIG. 1 illustrates a first embodiment of a variable beamwidth antenna system 10 in accordance with the principles of the present invention. The variable beamwidth antenna system 10 comprises a main reflector 11, a subreflector 12, a feed horn 13, a feed horn displacement mechanism 14, and a main reflector displacement mechanism 15. The function of the feed horn displacement mechanism 14 is to reposition the feed horn 13, and the function of the main reflector displacement mechanism 15 is to reposition the main reflector 11.

The subreflector 12 is a sector of an ellipsoidal surface, whose two foci are at O' and 0. The main reflector is a sector of paraboloidal surface. When the antenna is in the focused position, i.e., the case where neither the main reflector 11 nor the feed horn 13 is displaced, the focal point of the main reflector 11 is located at O', and the feed horn 13 is located at O, as shown in FIG. 1. Point A in FIG. 1 is the intersection point of the axis of the feed horn 13 and the surface of the subreflector 12. Point B is the intersection of the surface of the main reflector 11 and line AO'. The distance OA is "c" in Equation (1) below, and the distance AO' is "d" in Equation (1).

$$y = \frac{d^2x}{c^2 - x(c+d)} \tag{1}$$

where "x" is the distance of RF feed horn displacement, and "y" is the distance of the main reflector displacement. Under the focused position, the antenna system 10 provides the narrowest radiation pattern.

Figure 2:
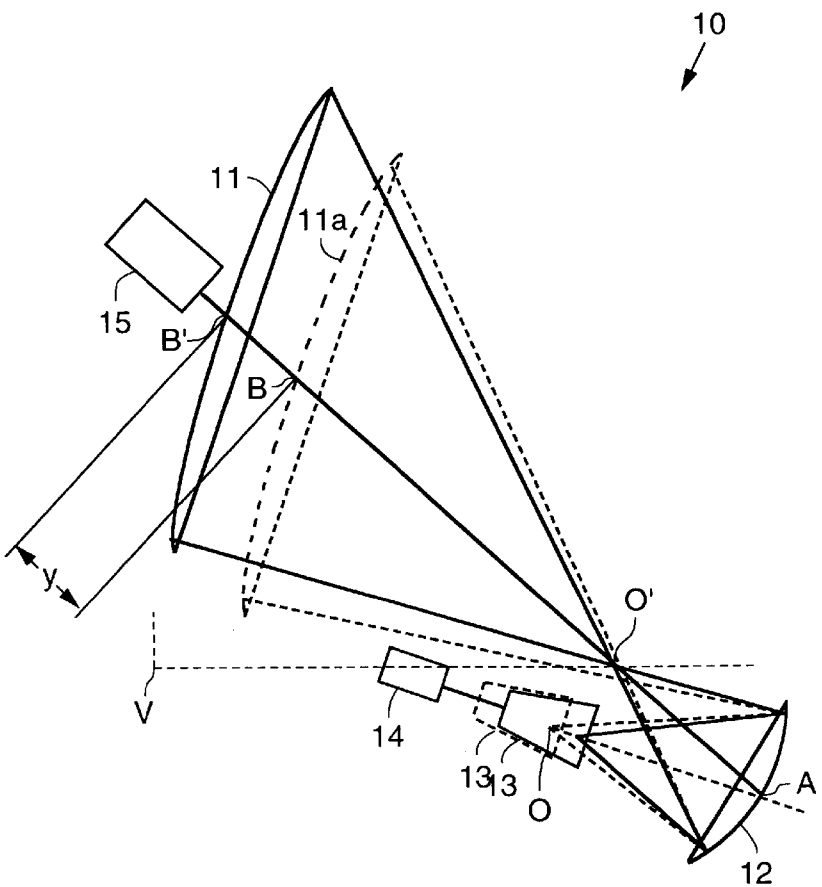
FIG. 2 illustrates a reduced-to-practice embodiment of the variable beamwidth antenna system shown in FIG. 1.

FIG. 2 illustrates the action of a reduced-to-practice embodiment of the variable beamwidth antenna system 10. In order to broaden the beamwidth, two mechanical motions are required. First, the feed displacement mechanism 14 must push (or reposition) the feed horn 13 closer to the subreflector 12. 13a in FIG. 2 is the new feed horn position. Second, the reflector displacement mechanism 15 must pull (or reposition) the main reflector 11 farther away from the subreflector 12. The new position of the main reflector is identified as main reflector 11a in FIG. 2. The feed horn displacement "x" and the main reflector displacement "y" are not two independent variables. They are related by Equation (1).

Figure 3:
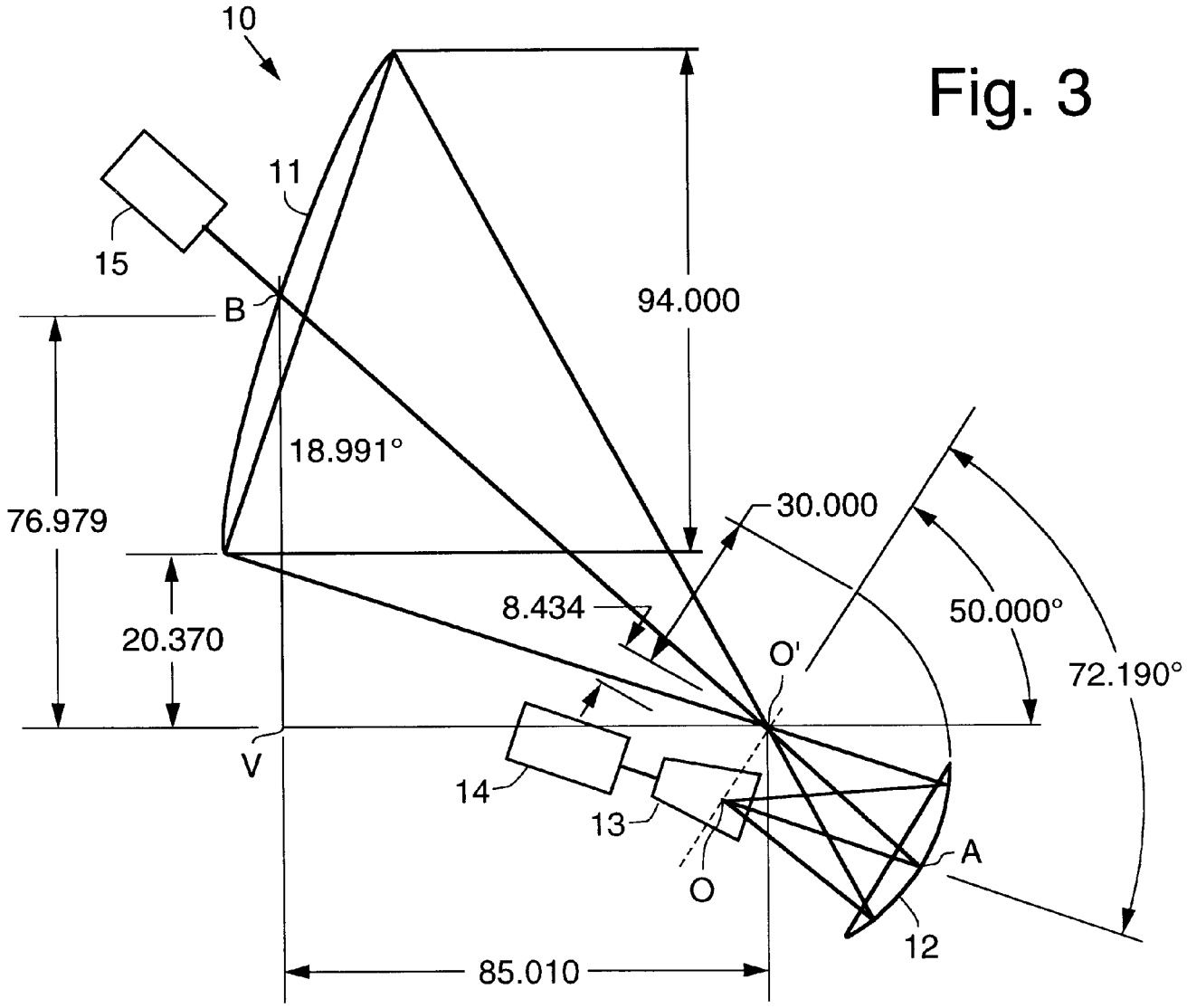
FIG. 3 illustrates design parameters of exemplary variable beamwidth antenna system when the antenna is in focused condition.

A numerical example will now be illustrated. An exemplary variable beamwidth antenna system 10 with exemplary design parameters is shown in FIG. 3. For this antenna geometry, c=38.138 inches and d=36.826 inches.

Figure 4:
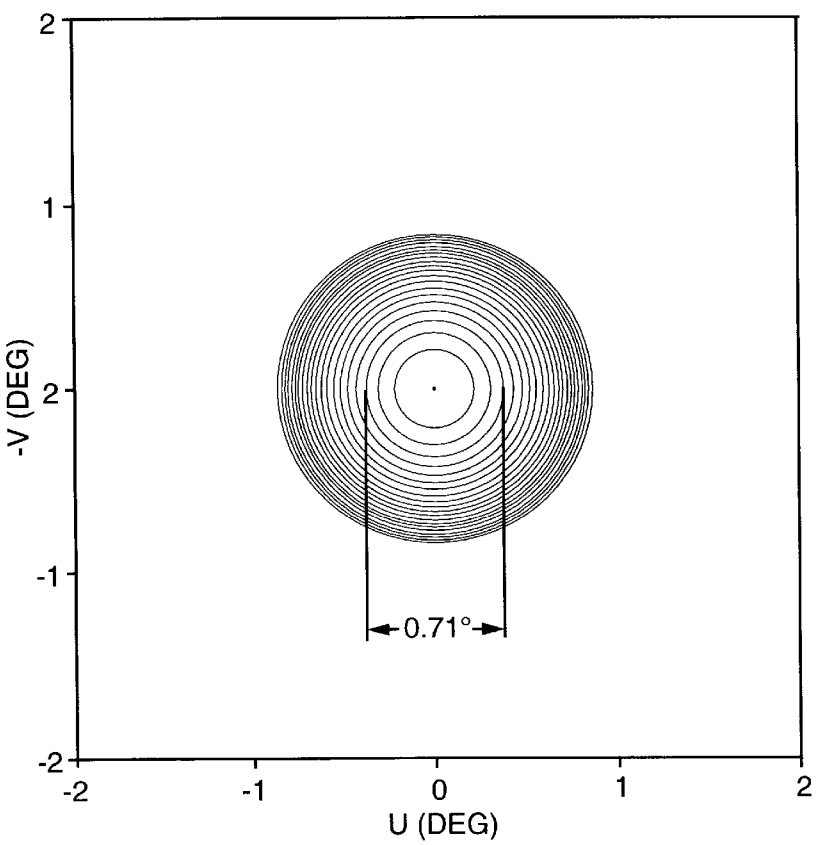
FIG. 4 illustrates the antenna radiation pattern of the antenna shown in FIG. 3.

FIG. 4 shows radiation contours of the exemplary system 10 when the system is in focus, i.e., when x=y=0. The 3 dB beamwidth of the beam shown in FIG. 4 is approximately 0.7 degrees.

Figure 5:
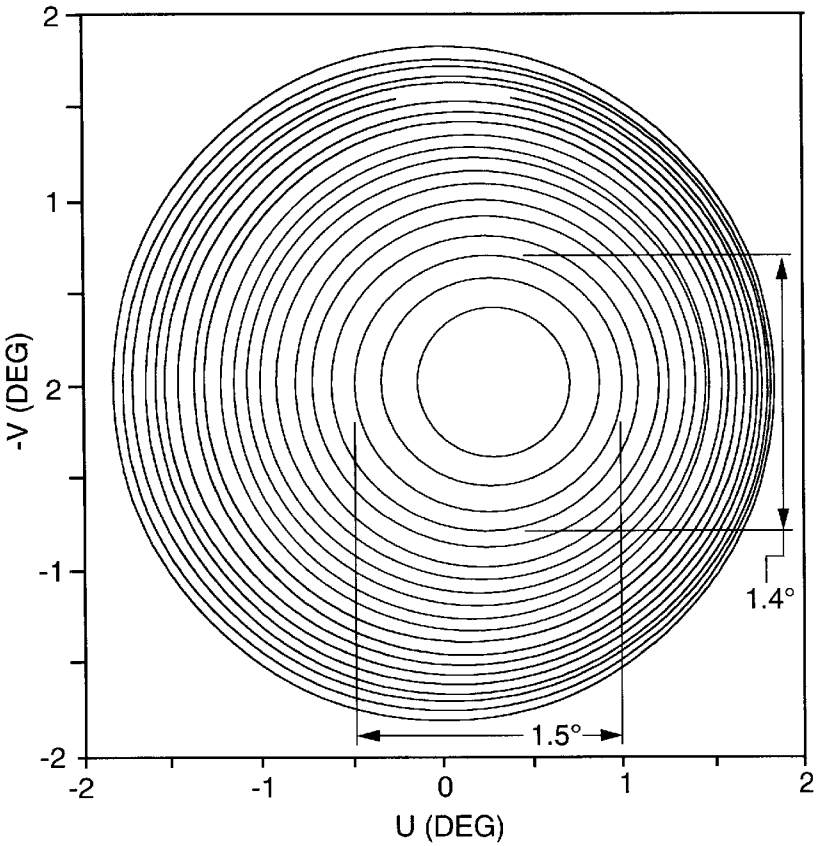
FIG. 5 illustrates the broadened radiation pattern of the antenna shown in FIG. 3 after displacement of the main reflector and the feed horn displaced in accordance with the principle of this invention.

FIG. 5 shows the radiation contours of the exemplary system 10 when x=11.0 inches and y=23.68 inches (from Equation (1)). The 3 dB beamwidth of the beam shown in FIG. 4 is broadened to 1.45 degrees from 0.71 degrees.

Due to optical aberration, Equation (1) is an approximate expression for the displacement of the main reflector 11a of the variable beamwidth antenna system 10. For practical applications, a fine-tuning of the location of the main reflector 11a may be required.

Figure 6:
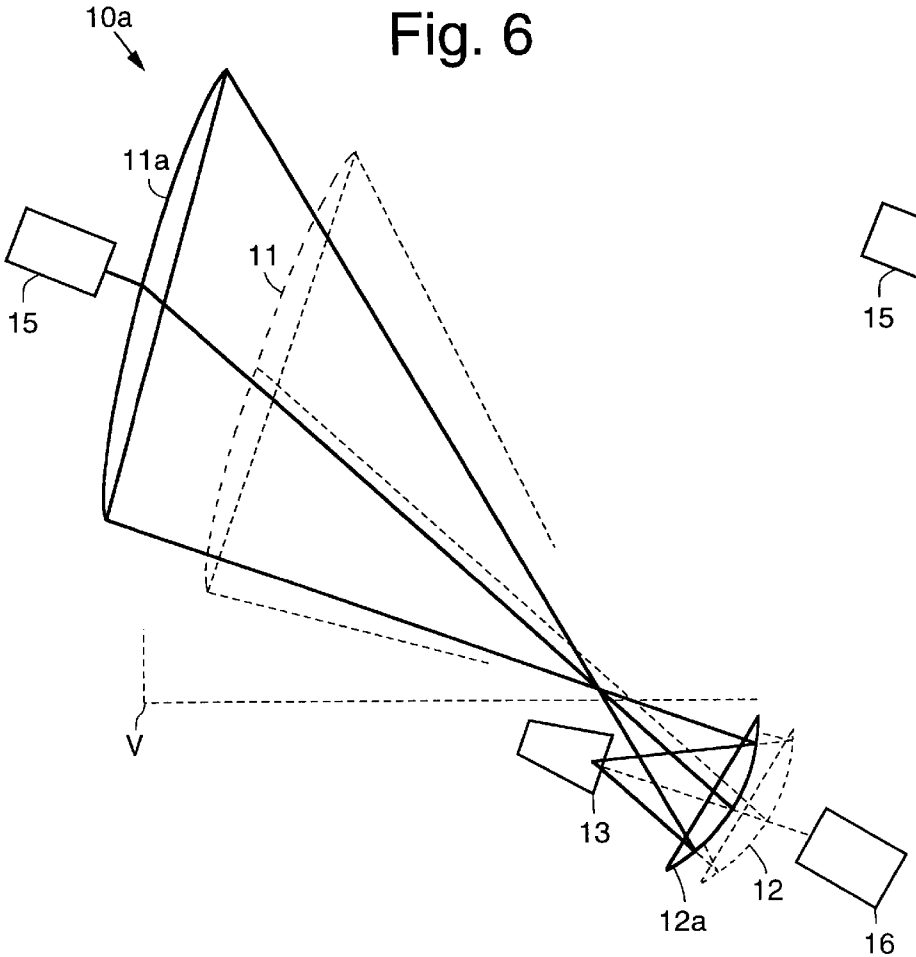
FIG. 6 illustrates a second embodiment of a variable beamwidth antenna system in accordance with the principles of the present invention.

It is also to be understood that the RF feed horn 13 can be made stationary instead of the subreflector 12 as shown in FIG. 6. More particularly, FIG. 6 illustrates a second embodiment of a variable beamwidth antenna system 10a in accordance with the principle of the present invention.

In the second embodiment of the variable beamwidth antenna system 10a, the subreflector displacement mechanism 16 displaces the subreflector 12 to a proper location and the main reflector displacement mechanism 15 displaces the main reflector 11 to a proper location while keeping the RF feed horn stationary. This system 10a in FIG. 6 is equivalent to the variable beamwidth antenna system 10 described above with reference to FIG. 2.

Figure 7:
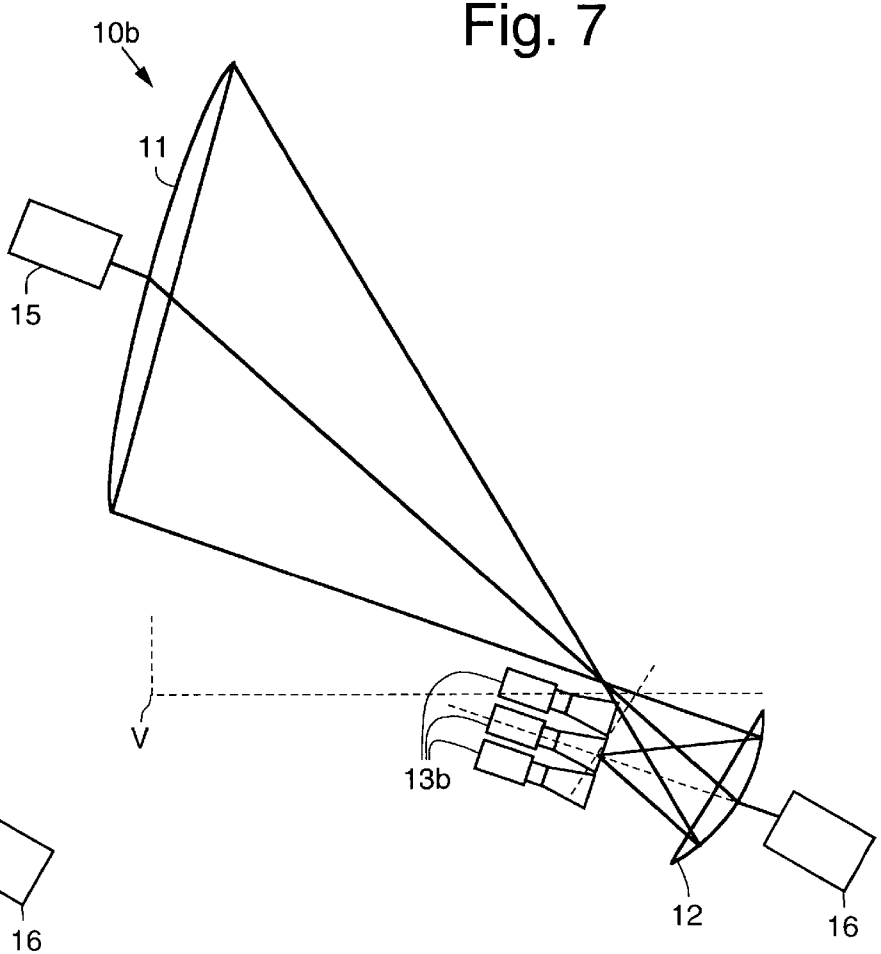
FIG. 7 illustrates a third embodiment of a variable beamwidth antenna system in accordance with the principles of the present invention.

Referring now to FIG. 7, it illustrates a third embodiment of a variable beamwidth antenna system 10b in accordance with the principles of the present invention. In the third embodiment of the variable beamwidth antenna system 10b shown in FIG. 6, there are plurality of RF feed horns 13b used instead of a single RF feed horn 13. As a result, there will be multiple variable beams produced by the system 10b.

Thus, improved variable beamwidth antenna systems have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A variable beamwidth antenna system comprising:

a subreflector comprising a sector of an ellipsoidal surface having foci at points O' and O;

a main reflector comprising a sector of paraboloidal surface having a vertex V and having its focal point located at O';

a feed horn having its phase center located at O;

a main reflector displacement mechanism; and a feed horn displacement mechanism;

wherein the RF feed horn is controlled by the feed horn displacement mechanism and which is moved a distance "x" closer to the subreflector, and the main reflector is controlled by the main reflector displacement mechanism which is moved a distance "y" away from the subreflector, wherein the displacements "x" and "y" satisfy the equation $$y = \frac{d^2x}{c^2 - x(c+d)},$$

and wherein "c" and "d" are the distance between the RF feed horn and the subreflector, and the distance between the focal point of the main reflector and subreflector, respectively, before the displacements of the RF feed horn and the main reflector.

2. The system recited in claim 1 wherein point A is the intersection point of a line through the axis of the feed horn and the surface of the subreflector, and point B is the intersection point of a line through point A and O' and the surface of the main reflector;

wherein the main reflector is moved away from the subreflector along a line through points A, O' and B and is located at a distance from point O' equal to the distance between points O' and B plus "y", where the distance "y" is determined by the equation; and wherein "c" is the distance between O and A, "d" is the distance between O' and A, and the feed horn and the subreflector are separated along a line through points A and O by a distance equal to the distance between points A and O minus "x".

3. The system recited in claim 1 wherein the feed horn is moved toward the subreflector along a line through points A and O by a distance "x" relative to point O.

4. The system recited in claim 1 wherein the subreflector is moved toward the feed horn along a line through points A and O by a distance "x" relative to point A.

5. The system recited in claim 1 comprising:

a plurality of feed horns.

6. A variable beamwidth antenna system comprising:

a subreflector comprising a sector of an ellipsoidal surface having focal points located at points O' and O;

a main reflector comprising a sector of paraboloidal surface having a vertex V and having its focal point located at O';

feed horn having its phase center located at O;

a main reflector displacement mechanism; and a feed horn displacement mechanism;

wherein the RF feed horn is controlled by the feed horn displacement mechanism and which is moved a distance "x" closer to the subreflector, and the main reflector is controlled by the main reflector displacement mechanism which is moved a distance "y" away from the subreflector, wherein the displacements "x" and "y" satisfy the equation $$y = \frac{d^2x}{c^2 - x(c+d)},$$

and wherein "c" and "d" are the distance between the RF feed horn and the subreflector, and the distance between the focal point of the main reflector and subreflector, respectively, before the displacements of the RF feed horn and the main reflector.

7. A variable beamwidth antenna system comprising:

a subreflector comprising a sector of an ellipsoidal surface having focal points located at O' and O;

a main reflector comprising a sector of paraboloidal surface having a vertex V and having a focal point located at point O';

a feed horn located at point O';

a main reflector displacement mechanism; and a subreflector displacement mechanism;

wherein point A is the intersection point of a line through the axis of the feed horn and the surface of the subreflector, and point B is the intersection point of a line through points A and O' and the surface of the main reflector;

wherein the main reflector is moved away from the subreflector along a line through points A, O' and B and is located at a distance from point O' equal to the distance between points O' and B plus "y", where the distance "y" is given by the equation $$y = \frac{d^2 x}{c^2 - x(c+d)},$$

and wherein "c" is the distance between O and A, "d" is the distance between O' and A, and the subreflector is moved toward the feed horn along a line through points A and O by a distance "x" relative to point A.

* * * * *